United States Patent [19]

Dykstra

[11] Patent Number: 4,482,066

[45] Date of Patent: Nov. 13, 1984

[54] STORAGE RACK WITH AN EXTENDIBLE SHELF STRUCTURE

[76] Inventor: Donald P. Dykstra, 556 Lyman, DesPlaines, Ill. 60016

[21] Appl. No.: 423,250

[22] Filed: Sep. 24, 1982

[51] Int. Cl.[3] ..... A47F 5/00

[52] U.S. Cl. ..... 211/151; 312/281; 312/330 R; 312/333; 312/341 R; 312/348

[58] Field of Search ..... 211/151, 490, 182; 106/143; 312/338, 339, 341 R, 344, 350, 348, 330 R, 281, 333

[56] References Cited

U.S. PATENT DOCUMENTS

| | | | |
|---|---|---|---|
| 1,204,347 | 11/1916 | DeCanio | 312/341 R |
| 2,125,619 | 8/1938 | Parent | 312/341 R |
| 2,726,915 | 12/1955 | Schuette | 312/341 |
| 4,275,940 | 6/1981 | Draper | 312/348 |

FOREIGN PATENT DOCUMENTS

| | | | |
|---|---|---|---|
| 737315 | 6/1980 | U.S.S.R. | 211/151 |

*Primary Examiner*—William E. Lyddane
*Assistant Examiner*—Joseph Falk

[57] ABSTRACT

A storage rack assembly having at least one storage shelf movable from a storage position to a fully extended position to enable loading and unloading characterized by a rack having a pair of side frame units which are interconnected to form a rack having an open front and at least one movable shelf assembly disposed in the rack and being movable from the storage position to a fully extended position extending out of the open front of the rack. Each shelf assembly includes a rigid shelf having side elements supporting spaced rollers, a rigid carriage having an open end and side members provided with a channel for receiving the rollers of the shelf for movement therein and the side elements of the carriage provide vertically spaced track surfaces which are received between two pairs of rollers on each side of the rack to enable the carriage to move in the rack.

14 Claims, 8 Drawing Figures

STORAGE RACK WITH AN EXTENDIBLE SHELF STRUCTURE

BACKGROUND OF THE INVENTION

A storage rack having a plurality of frame members interconnected to form a frame having a pair of side frame units and an open front with at least one movable shelf assembly being disposed in the rack and movable between a storage position to a fully extended position with the shelf completely extended out of the front of the rack to enable loading and unloading of the shelf without interference from the rack.

Storage racks for storing various parts, such as dies, jigs and sub-assemblies, are known. A storage rack having a rack formed of vertical frame members interconnected by transverse horizontal frame members to form side frame units which are interconnected at the top and bottom to provide at least a rack with an open front are known. In these racks, a shelf is mounted to move on slides or rollers from a retracted position fully within the rack to an extended position with a part of the shelf extending out of the front of the rack to enable loading and unloading of the shelf. However, only a portion of the surface of each shelf can be utilized because of interference with either other shelves and/or the members of the rack during loading and unloading of material from the shelves.

SUMMARY OF THE INVENTION

The present invention is directed to providing a storage rack having a rack with shelf assemblies which shelf assemblies are constructed to enable a full extension of the shelf out of the front end of the rack so that 100% of the shelf space can be utilized. In addition, the present invention provides a storage rack which can provide heavy-duty storage for heavy, enlarged objects which have shelf assemblies which besides providing at least 100% utilization of the shelf are easy to move between the storage position and the extended position.

In order to accomplish these goals, the present invention is directed to a storage rack having at least one storage shelf movable from a storage position to a fully extended position to enable loading and unloading of the shelf, said storage rack comprising a rack having a pair of side frame units of vertical frame members interconnected by transverse frame members, said side frame units being interconnected by additional frame members to form the rack having an opened front; and at least one movable shelf assembly being disposed in said rack, each movable shelf assembly including a rigid carriage with an open end being formed by a pair of side members interconnected by transverse carriage elements, a rigid shelf having a shelf surface supported by side elements interconnected by transverse shelf elements, first mounting means for mounting said rigid shelf for movement in a path in said carriage between a first position received in the carriage and a second position with a portion extending out of said open end of said carriage, and second mounting means for mounting said carriage in said rack for movement in a path between a third position retracted within the rack and a fourth position with a portion of the carriage extending out of said open front of said rack, said first mounting means including one of said side element and side member at each side of the rigid shelf having means forming a first track and the other of said side member and side element having spaced rollers mounted in spaced relationship thereon for engaging said track, said second mounting means including each side member of the carriage having means forming a linear second track and each of the side frame units having spaced rollers engaging said linear second track to support the carriage as it moves between the third and fourth positions so that with the shelf in the second position and the carriage in the fourth position, said shelf is fully extended out of the open front of the rack to enable loading and unloading of the shelf without interference from the rack and other shelves.

Preferably, the means forming the first track comprises a U-shaped channel member having a pair of substantially parallel horizontal track surfaces and the channel member is mounted on the carriage and receives rollers which are mounted on the side elements of the shelf. Preferably, the rollers are mounted on the side element of the shelf with the axis of the front roller being mounted at a greater distance from the shelf surface than the axis of the back roller so that the shelf when in a storage position has a front end of the shelf higher than the rear end.

Preferably, the means forming the second track comprises a track member such as a plate forming a pair of vertically spaced-apart parallel horizontal tracks and each of the side frame units has at least two pairs of vertically spaced rollers arranged with the track or plate member extending therebetween and the vertically spaced horizontal track surfaces being engaged by the rollers as the carriage moves between the third and fourth position.

In order to prevent binding of the rollers on each of the shelves in the respective channel members as the shelf assembly is moved from the fully extended position toward the storage position, friction means are provided. Preferably, the friction means include a detent means which is mounted on the shelf and comprises a ball biased into a recess, which is formed in one of the transverse carriage elements when the shelf is in the second position. Thus, during movement of the shelf from the extended position to the storage position, the carriage will complete its movement from the fourth to the third position before the shelf will start to move from the second to the first position.

DESCRIPTION OF THE PREFERRED EMBODIMENTS

Figure 1:
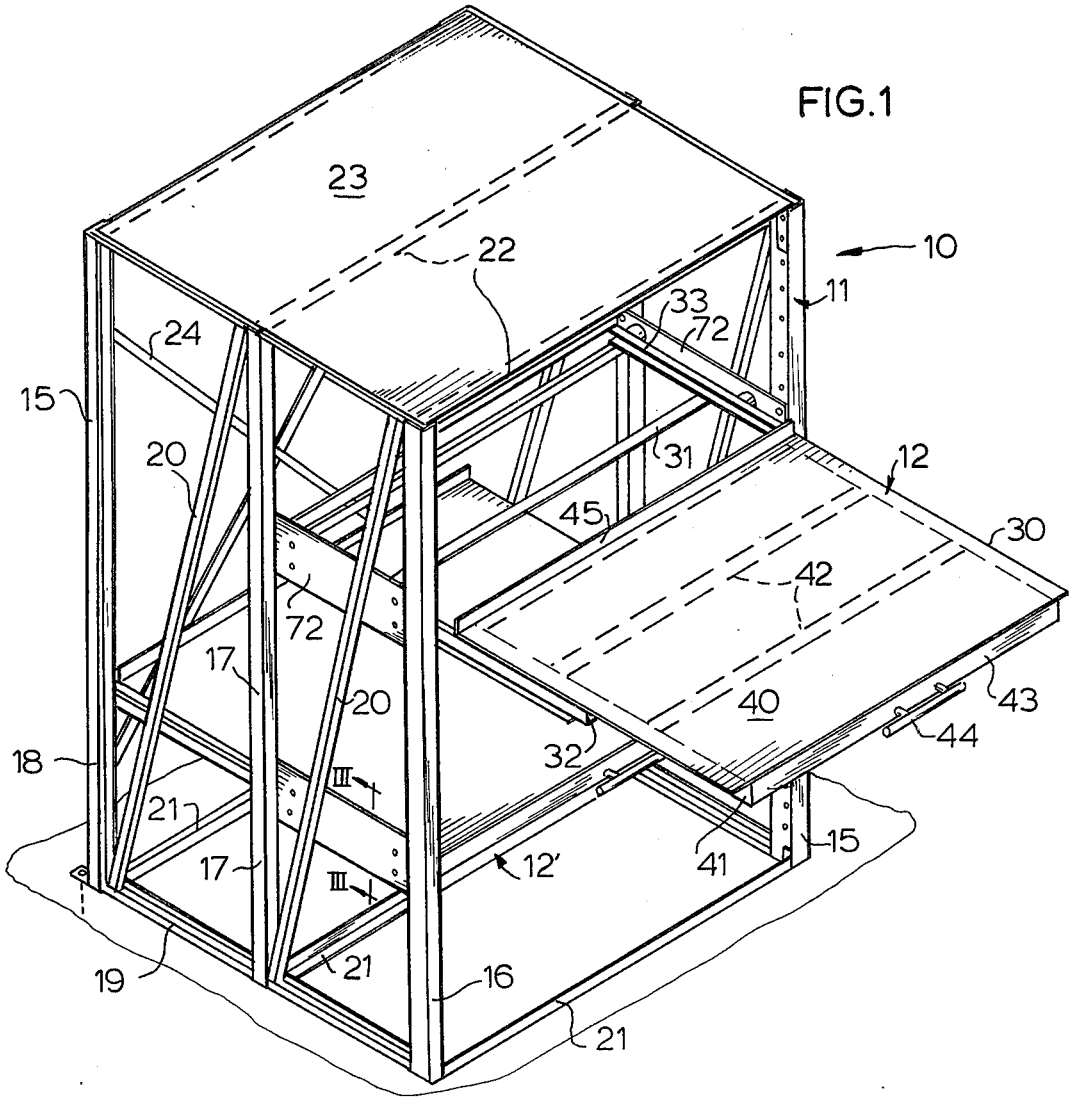
FIG. 1 is a perspective view of the storage rack according to the present invention with one of the shelves in the retracted position and a second shelf in the fully extended position.

The principles of the present invention are particularly useful in a heavy-duty storage rack generally indicated at 10 in FIG. 1. The storage rack 10 includes a rack generally indicated at 11 which contains two shelf assemblies generally indicated at 12 and 12'. As illustrated, the shelf assembly 12 is in the fully extended position while the shelf assembly 12' is in the fully retracted or storage position.

The rack 11 is composed of a pair of side frame units 15, each of which is formed by three vertical frame members 16, 17 and 18 which are interconnected by transverse members such as 19 and other members such as 20 to form each unit. The two units are connected together by additional members such as frame members 21 and 22 to form a rack with an open front. As illustrated, the frame members 22, which are on the top of the rack, support plate 23 to form a fixed top shelf. Also, as illustrated, the back of the rack is closed by frame members such as 24 which extend between the two side frame units.

Each of the shelf assemblies 12 and 12' include a rigid shelf 30 and a rigid carriage 31. The shelf assembly also includes first mounting means 32 for mounting the shelf 30 for movement along a path in the carriage and second mounting means 33 for mounting the carriage 31 for movement along a path in the rack 11.

Figure 3:
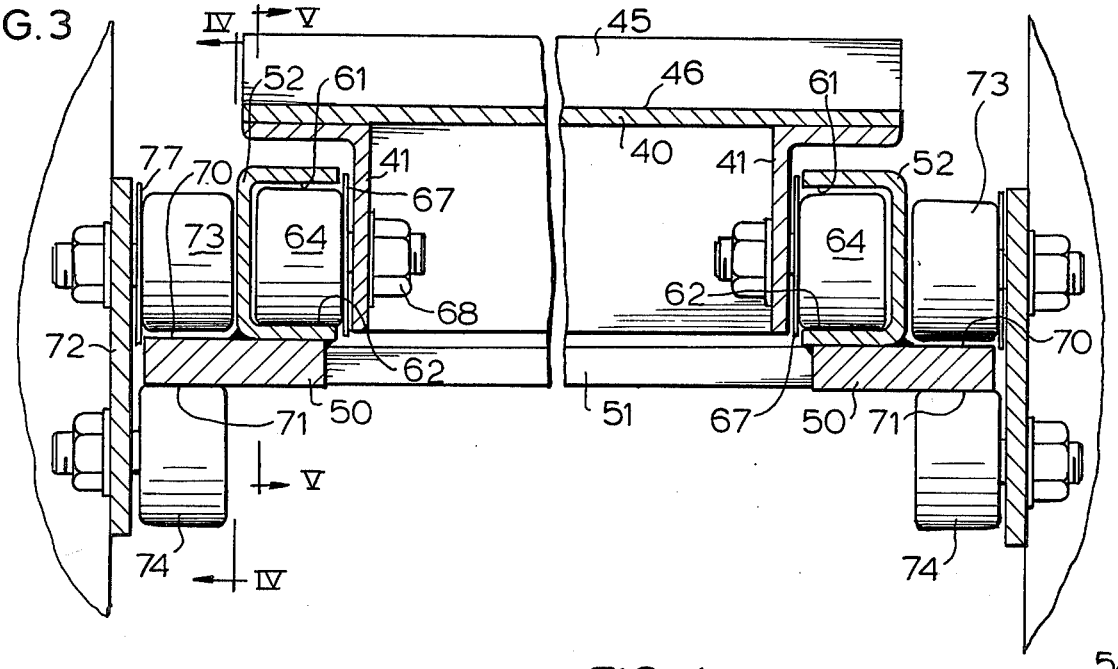
FIG. 3 is a cross-sectional view taken along the lines III—III of FIG. 1.
Figure 5:
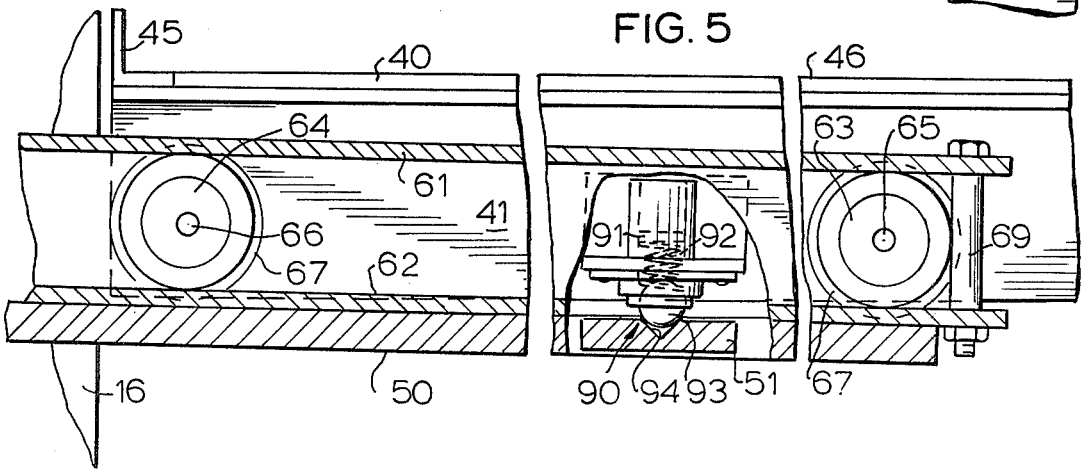
FIG. 5 is a partial cross-sectional view taken along the lines V—V of FIG. 3.

The shelf 30 as best illustrated in FIGS. 1, 3 and 5 has an upper shelf surface 46 which is formed by a plate or plates 40 which rest on a shelf frame formed by side elements 41, 41 which are connected together by transverse shelf elements such as 42. As illustrated, the side elements are formed of angle iron to provide L-shaped members while the transverse shelf elements 42 can be T-shaped members. In addition, as best illustrated in FIG. 1, the front of each shelf such as 30 can be closed by a front member 43 which has a handle 44 and the rear can be closed by an angle iron member 45. If desired, additional angle iron members can be placed on the other edges of the shelf to form a retaining edge.

The carriage comprises a pair of side members 50, which are interconnected (see FIG. 6) by a plurality of transverse carriage members 51 and a back member 54 to form the rigid carriage with an open front end. Also, channel members 52 (FIG. 3) are welded to the top surface of each side member 50.

To form the first mounting means 32, the channel member 52 provides a pair of vertically spaced parallel, horizontally extending track surfaces 61 and 62. A pair of rollers including a front roller 63 and a back rear roller 64 are mounted on each side element 41 of the shelf 30. As illustrated in FIG. 5, the front roller 63 has a center or axis 65 which is at a greater distance from the upper surface 46 of the shelf than the center or axis 66 of the rear or back roller 64 from the same surface. It is noted that this increase is exaggerated in FIG. 5 and preferably is only approximately $\frac{1}{8}$ of an inch. It is also noted that the distance between the centers or axes 65 and 66 is approximately $19\frac{1}{2}$ inches. The result of this difference is that the front edge of the shelf such as 30 will be higher than the rear edge when the shelf is in the stored position and the shelf will be substantially horizontal while in the fully extended position due to the cantilever supporting of the shelf and the weight received thereon. It should also be noted that each of the rollers such as 63 and 64 are provided with a slight clearance relative to the two horizontal track surfaces 61 and 62. Also, each of the rollers when mounted on the side element is provided with a washer such as 67 as the shaft of the roller is secured by threaded fastening means such as the nut 68 in the element 41. The washers 67 prevent the edges of the channels 52 from digging into the elements 41. To limit the movement of the shelf 30 in carriage 31, the stop 69, which is a bolt extending across the channel 52, is provided.

Figure 4:
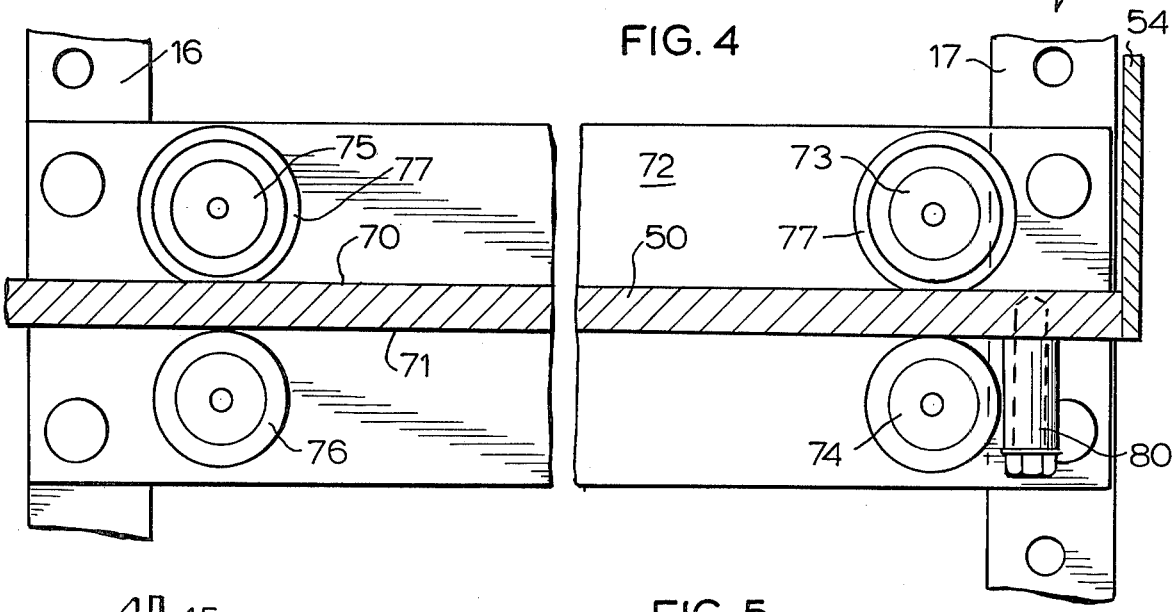
FIG. 4 is a partial cross-sectional view taken along the lines IV—IV of FIG. 3.

The second means 33 for mounting includes the side members 50 of the carriage 31 providing a pair of vertically spaced, horizontally extending parallel track surfaces 70 and 71. To engage these surfaces, a plate 72 supports four rollers 73–76 with the rollers 73 and 74 being arranged as a vertically spaced pair and the rollers 75 and 76 being arranged as a second vertically spaced pair of rollers. As illustrated, the plate 72 is mounted on each side frame unit 15 by being bolted to vertical frame members 16 and 17. As in the previously described rollers such as 63 and 64, at least one roller of each pair such as the top rollers 73 and 75 is provided with a washer 77 to prevent the edge of the member 50 from digging into or rubbing on plate 72. As illustrated, each of the pairs formed by the rollers 73–76 are arranged so that the plate member 50 forming the side member of the carriage extends therebetween and one of the track surfaces 70 and 71 will be engaged on the rollers depending on the particular weight and position of the carriage. To prevent the carriage from being pulled out between the rollers, a stop such as 80 may be provided near the rear or back of the carriage and as illustrated comprises a sleeve secured by a bolt to the member 50. It is also noted from FIG. 4 that each of the plates 72 can be adjustably mounted on the vertical members 16 and 17 to enable adjusting the position of the shelf assembly 12 at the desired height or position in the rack 11.

Figure 2:
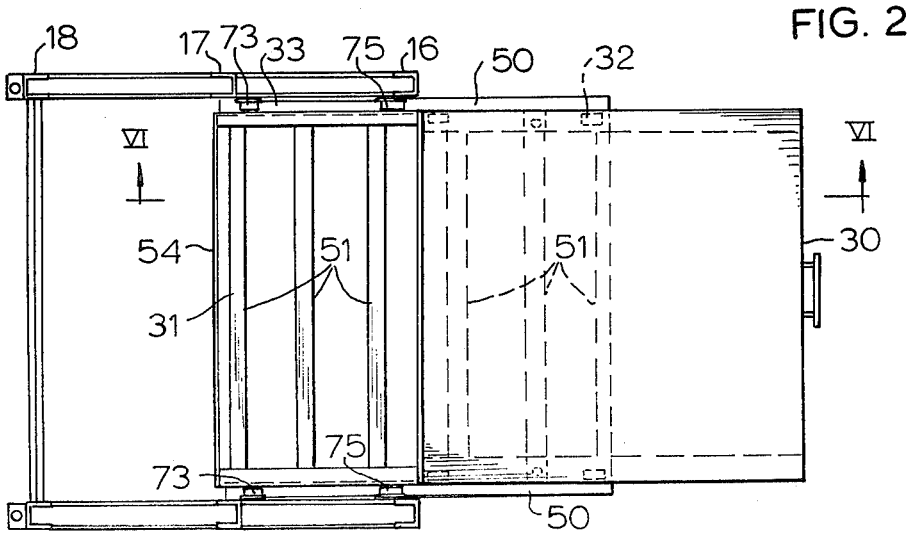
FIG. 2 is a top view with the top of the rack removed for purposes of illustration of the storage rack with the shelf assembly in the fully extended position.
Figure 6:
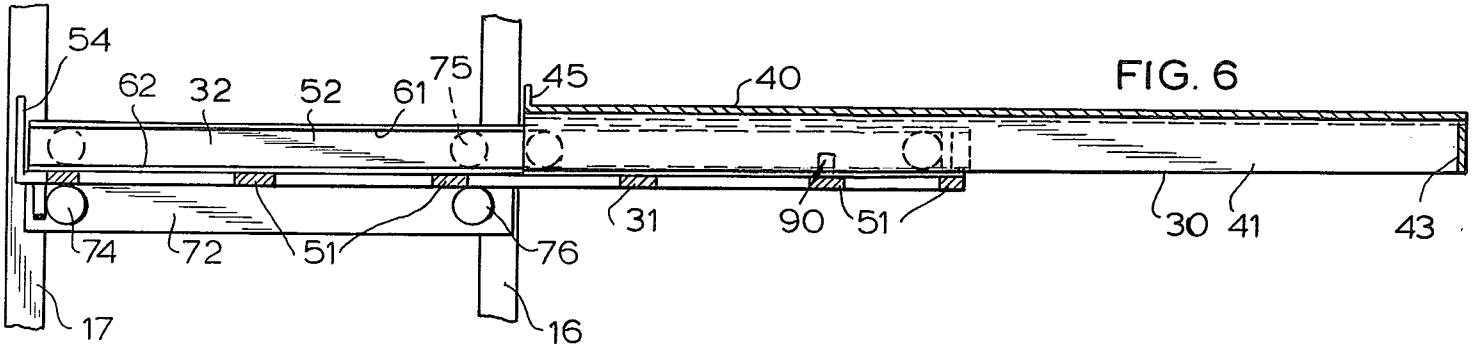
FIG. 6 is a partial cross-sectional view taken along the lines VI—VI of FIG. 2.
Figure 7:
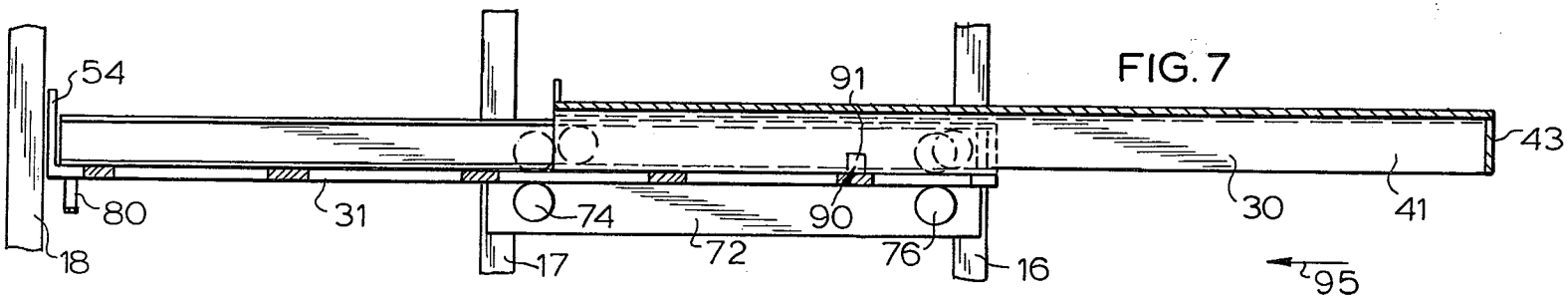
FIG. 7 is a partial cross-sectional view similar to FIG. 6 showing the shelf assembly in a partially extended position.
Figure 8:
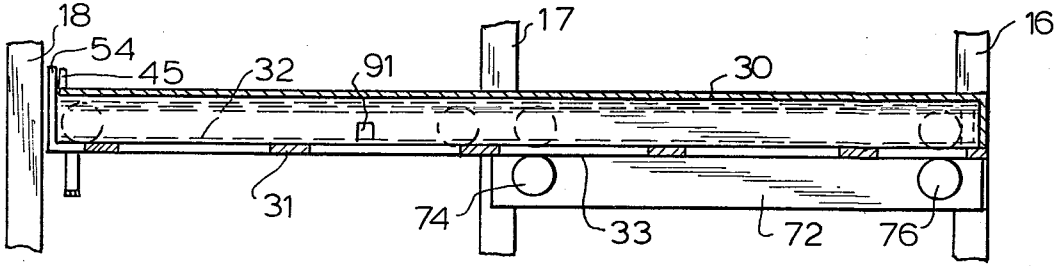
FIG. 8 is a partial cross-sectional view similar to FIG. 7 with the shelf in the fully retracted or storage position.

With the first mounting means 32, the shelf 30 can move from a first position which is completely received in the carriage 31 such as illustrated by the shelf 30 in FIG. 8 to a second position illustrated in FIG. 6 with a portion of the shelf 30 extending out of the open end of the carriage 31. The second mounting means 33 allows the carriage 31 to move from a third position such as illustrated in FIG. 7 with the carriage 31 being received in the rack 11 to a fourth position illustrated in FIG. 6 with a portion of the carriage 31 extending out of the open front of the rack. As best illustrated in FIGS. 2 and 6, approximately half of the carriage 31 is supported in the rack while the carriage is in the fourth position and approximately half of the shelf 30 is supported in the carriage 31 when the shelf is in the second position so that with the carriage in the fourth position and the shelf in the second position, approximately 100% of the shelf 30 is out of the rack 11. Thus, easy access to enable loading objects on the surface of the shelf can occur.

When moving the shelf assembly from the stored position such as shown by the assembly 12' to the extended position such as shown by the shelf assembly 12 in FIG. 1, both the carriage 31 and the shelf 30 will move on the various mounting means along their paths between their various positions. Whether one completes its move before the other depends on the particular friction acting on the various rollers of the two mounting means. However, when moving the shelf from the extended position such as illustrated in FIGS. 2 and 6, it is ideal because of the particular deflection of the extended carriage 31 and shelf 30 that the carriage 31 complete its movement from the fourth position to the third position before the shelf 30 starts to move between the second position to the first position. To insure that this occurs, friction means, such as generally indicated at 90 in FIG. 5, are provided. As illustrated, the embodiment of the friction means 90 comprises detent means 91, which has a spring 92 urging a ball 93 into a recess 94. In the particular manner of mounting, the recess 94 is formed in one of the transverse carriage elements or members 51 and the detent means 91 is mounted on an inside surface of one of the side elements 41 of the shelf. It should be noted that any other arrangement can be utilized.

The purpose of the friction means 90 is to hold the shelf 30 in the second position in the carriage 31 while the carriage is being moved from the fourth position to the third position. Thus, as best illustrated in FIGS. 5 and 6, the friction means 90 maintains the shelf 30 in the carriage 31 as the carriage 31 moves from the fourth position as illustrated in FIG. 6 to the third position as illustrated in FIG. 7. After the carriage has assumed the third position illustrated in FIG. 7, continual movement in the direction of an arrow 95 will overcome the frictional force of the detent means so that the shelf 30 can move from the second position in the carriage 31 toward the first position as illustrated in FIG. 8. As mentioned hereinabove, this particular sequence of movements of the shelf and carriage eliminates problems with binding of the rollers 63 and 64 of the shelf in the channels 52.

As mentioned hereinabove, the pairs of rollers such as the rollers 73 and 74 of the second mounting means are mounted so that the roller surfaces are slightly further apart than the parallel horizontal track surfaces 70 and 71. In a similar manner, the channel 52 is constructed so that the parallel surfaces 61 and 62 are slightly further apart than the diameter of the rollers 63 and 64. Thus, as the shelf 30 moves from the retracted or storage position, which has the shelf in the first position in the carriage which is in the third position, to the extended position which is illustrated in FIG. 6 and has the shelf in the second position while the carriage is in the fourth position, the weight on the shelf plus the weight of both the shelf and the carriage is such that the cantilever support of the shelf in the carriage as well as the cantilever support of the carriage in the rack formed by the first and second mounting means respectively will possibly deflect the shelf 30 and carriage 31 a slight amount. As mentioned hereinbefore, the rollers such as 64 and 65 are arranged so that the shelf has a slight pitch while in the storage position. This deflection as well as the particular arrangement and takeup of the tolerances between the track surfaces and the surfaces of the roller cause the shelf surface 46 to be substantially flat or horizontal while the shelf is in the extended position as illustrated in FIG. 6.

Another feature of the invention is the fact that the two side elements 41 of the shelf are formed of angle irons which extend out over the channels 52. Thus, the shelf surface 46 can have a wider width since a portion will overlie the first mounting means which mounts the shelf in the carriage. With regard to the surface of the shelf, it is illustrated as being a flat surface due to the plate 40. However, bins and/or other arrangements can be provided on the plate 40 or supported on the shelf frame formed by the transverse elements 42 and the side elements 41.

It should be noted that the use of the horizontal track surfaces such as 61 and 62 formed by the channel member 52 as well as the horizontal track surfaces 70 and 71 formed by the track member 50 of the carriage enable utilizing rollers which have a cylindrical surface. Thus, an easy match of the roller surface to the track surfaces can be obtained. Thus, problems with matching tapered roller surfaces to tapered track surfaces are eliminated.

While the storage rack 10 is illustrated as being an open rack, it is noted that the side frame units can be provided with sheet metal covers as well as the back to provide a closed storage rack. In addition, doors could be mounted on the vertical members 16 of each of the side frame units 15 so that the open front could be closed after each of the shelf assemblies 12 and 12' have been moved to the retracted or storage position.

Although various minor modifications may be suggested by those versed in the art, it should be understood that I wish to embody within the scope of the patent granted hereon, all such modifications as reasonably and properly come within the scope of my contribution to the art.

I claim:

1. A storage rack having at least one storage shelf movable from a storage position to a fully extended position to enable loading and unloading of the shelf, said storage rack comprising a rack having a pair of side frame units of vertical frame members interconnected by transverse frame members, said side frame unit being interconnected by additional frame members to form the rack having an open front; and at least one movable shelf assembly being disposed in said rack, each movable shelf assembly including a rigid carriage with an open end formed by a pair of side members interconnected by transverse carriage elements, a rigid shelf having a shelf surface supported by side elements interconnected by transverse shelf elements, first mounting means for mounting said rigid shelf for movement in a path in said carriage between a first position received in said carriage and a second position with a portion extending out of said open end of said carriage, and second mounting means for mounting said carriage in said rack for movement in a path between a third position retracted within the rack and a fourth position with a portion of the carriage extending out of said open front of said rack, said first mounting means including one of said side element and said side member at each side of the rigid shelf having means forming a first track and the other of said side member and side element having spaced rollers mounted in spaced relation thereon for engaging said track, said second mounting means including each side member of the carriage having means including a plate member for forming a pair of vertically spaced, horizontal track surfaces and each of the side frame units having spaced pairs of vertically spaced rollers arranged with the plate member extending therebetween and the rollers engaging said track surfaces to support the carriage as it moves between the third and fourth position so that with the shelf in a second position and the carriage in a fourth position, said shelf is fully extended out of the open front of the rack to enable loading and unloading the shelf without interference from the rack.

2. A storage rack according to claim 1, wherein said means forming the first track is on the side member and said spaced rollers of the first mounting means are a back roller and a front roller mounted on the side elements of the shelf.

3. A storage rack according to claim 2, wherein the center of the front roller is mounted on the side element of the shelf at a distance from the shelf surface greater than the center of the back roller so that when the shelf is in the storage position, the front end of the shelf is higher than the rear end.

4. A storage rack according to claim 2, wherein the means forming the first track forms a pair of vertically spaced parallel track surfaces with the rollers extending therebetween.

5. A storage rack according to claim 4, wherein the means for forming the first track comprises a U-shaped channel member having substantially parallel track surfaces.

6. A storage rack according to claim 5, wherein the center of each front roller is mounted a greater distance from the shelf surface than the center of each of the rear rollers so that when the shelf is in the storage position, the front edge of the shelf is higher than the rear edge.

7. A storage rack according to claim 2, wherein the rigid carriage and rigid shelf have coacting means to hold the shelf in a second position while moving the carriage from the fourth to the third position.

8. A storage rack according to claim 7, wherein the means to hold comprises a recess in one of said rigid carriages and rigid shelf and a detent means being mounted on the other of said rigid carriage and shelf for engagement in said receess when the shelf is moved to the second position.

9. A storage rack according to claim 6, which includes friction means for holding the shelf in said second position as the carriage is moved from the fourth to the third position so that the shelf is moved from the second to the first position when the carriage is in the third position to prevent binding of the rollers of the shelf in said channel member.

10. A storage rack according to claim 1, wherein each pair of rollers of the second mounting means has one roller with a washer between the roller and side frame unit to prevent the plate member from engaging the side frame unit.

11. A storage rack having at least one storage shelf movable from a storage position to a fully extended position to enable loading and unloading of the shelf, said storage rack comprising a rack having a pair of side frame units of vertical frame members interconnected by transverse frame members, said side frame units being interconnected by additional frame members to form the rack having an open front; and at least one movable shelf assembly being disposed in said rack, each movable shelf assembly including a rigid carriage with an open end formed by a pair of side members interconnected by transverse carriage elements, a rigid shelf having side elements interconnected by transverse shelf elements, first mounting means for mounting said rigid shelf for movement in a path in said carriage between a first position received in said carriage and a second position extending out of said open end of the carriage, and second mounting means for mounting said carriage in said rack for movement in a path between a third position retracted within the rack and a fourth position with a portion of the carriage extending out of said open front of said rack, said first mounting means including each of said carriage side members having means including a channel member for forming a pair of vertical spaced horizontal parallel track surfaces and each of the side elements having spaced rollers mounted in horizontally spaced relationship to extend between and engage said track surfaces, said second mounting means including said carriage side members having means including a plate member for forming a pair of vertically spaced, horizontal track surfaces and each of the side frame units having spaced pairs of rollers arranged with the plate member extending therebetween and the roller engaging said track surfaces to support the carriage as it moves between the third and fourth position so that with the shelf in a second position and the carriage in a fourth position, said shelf is completely fully extended from the rack frame to enable loading and unloading the shelf without interference from the rack.

12. A storage rack according to claim 11, which includes friction means for temporarily holding said shelf in the second position as the rigid carriage is moved from said fourth to third position.

13. A storage rack according to claim 12, wherein said friction means comprises a detent means being mounted on said shelf and having a ball being biased into a recess of the carriage when the shelf is in said second position.

14. A storage rack having at least one storage shelf movable from a storage position to a fully extended position to enable loading and unloading of the shelf, said storage rack comprising a vertically standing rack having at least one pair of horizontally extending frame members; and at least one movable shelf assembly being disposed in said rack, each movable shelf assembly including a rigid carriage with an outer end formed by a pair of side members interconnected by at least one transverse carriage element, a rigid shelf having a shelf surface supported by side elements interconnected by transverse shelf elements, first mounting means for mounting said rigid shelf for movement in a path on said carriage between a first position received in said carriage and a second position with a portion extending past the outer end of said carriage, and second mounting means for mounting said carriage in said rack for movement in a path between a third position retracted within the rack and a fourth position with a portion of the carriage extending past the frame members of said rack, said first mounting means including the side member at each side of the carriage having means forming a first track and the side element having spaced rollers mounted in spaced relation thereon for engaging said track, said second mounting means including each side member of the carriage having means including a plate member for forming a pair of vertically spaced, horizontal track surfaces and each of the frame members having spaced pairs of vertically spaced rollers arranged with the plate member extending therebetween and the rollers engaging said track surfaces to support the carriage as it moves between the third and fourth position so that with the shelf in a second position and the carriage in a fourth position, said shelf is fully extended beyond the frame members of the rack to enable loading and unloading the shelf without interference from the rack.

* * * * *